US009828935B2

(12) United States Patent
Ortmann

(10) Patent No.: US 9,828,935 B2
(45) Date of Patent: Nov. 28, 2017

(54) INTERNAL COMBUSTION ENGINE

(71) Applicant: Audi AG, Ingolstadt (DE)

(72) Inventor: Matthias Ortmann, Nordheim (DE)

(73) Assignee: Audi AG, Ingolstadt (DE)

( * ) Notice: Subject to any disclaimer, the term of this patent is extended or adjusted under 35 U.S.C. 154(b) by 145 days.

(21) Appl. No.: 14/759,145

(22) PCT Filed: Dec. 5, 2013

(86) PCT No.: PCT/EP2013/003669

§ 371 (c)(1),
(2) Date: Jul. 2, 2015

(87) PCT Pub. No.: WO2014/086489

PCT Pub. Date: Jun. 12, 2014

(65) Prior Publication Data

US 2016/0025033 A1 Jan. 28, 2016

(30) Foreign Application Priority Data

Dec. 5, 2012 (DE) ..... 10 2012 023 803

(51) Int. Cl.
*F02F 1/40* (2006.01)
*F02F 1/42* (2006.01)
*F01P 3/02* (2006.01)

(52) U.S. Cl.
CPC *F02F 1/40* (2013.01); *F01P 3/02* (2013.01); *F02F 1/4214* (2013.01); *F01P 2003/024* (2013.01)

(58) Field of Classification Search
CPC .... F02F 1/40; F02F 1/4214; F02F 1/42; F01P 3/02; F01P 2003/024
(Continued)

(56) References Cited

U.S. PATENT DOCUMENTS 3,769,948 A * 11/1973 Feichtinger ..... F02F 1/40 123/188.14
4,083,333 A * 4/1978 Rudert ..... F02F 1/242 123/41.82 R
(Continued)

FOREIGN PATENT DOCUMENTS

CN 102691562 A 9/1926
DE 38 02 886 8/1988
(Continued)

OTHER PUBLICATIONS

International Search Report issued by the European Patent Office in International Application PCT/EP2013/003669 dated Apr. 9, 2014.
(Continued)

*Primary Examiner* — Joseph Dallo
*Assistant Examiner* — Scott A Reinbold
(74) *Attorney, Agent, or Firm* — Henry M. Feiereisen LLC

(57) ABSTRACT

An internal combustion engine includes a plurality of cylinders, each of which two intake valves and two exhaust valves, respectively arranged in a valve mount of a cylinder head of the internal combustion engine as well as a coolant distributing chamber and a coolant accumulating chamber being associated to. For each cylinder two coolant ducts are formed in the cylinder head and each is fluidly connected to the corresponding coolant distributing chamber and the corresponding coolant accumulating chamber. A first one of the coolant ducts on a first side extends about a first one of the intake valves and on a second side opposite the first side about a first one of the exhaust valves, and a second one of the coolant ducts extends on the first side about a second one of the intake valves and on the second side about a second one of the exhaust valves.

9 Claims, 1 Drawing Sheet

(58) Field of Classification Search
USPC ..... 123/41.74, 41.79, 41.82
See application file for complete search history.

(56) References Cited

U.S. PATENT DOCUMENTS

| | | | | |
|---|---|---|---|---|
| 4,106,444 | A * | 8/1978 | Deutschmann | F02F 1/166 123/193.5 |
| 5,615,641 | A | 4/1997 | Koch et al. | |
| 6,810,838 | B1 * | 11/2004 | Hellman | F01P 3/02 123/41.28 |
| 7,069,885 | B2 * | 7/2006 | Iida | F01P 3/16 123/41.82 R |
| 7,234,422 | B2 * | 6/2007 | Schlautman | F02F 1/40 123/41.74 |
| 8,960,134 | B1 * | 2/2015 | Zandeh | F01P 3/02 123/41.28 |
| 2002/0124815 | A1 * | 9/2002 | Ishiguro | F02F 1/242 123/41.82 R |
| 2007/0079776 | A1 | 4/2007 | Moller et al. | |
| 2010/0089343 | A1 * | 4/2010 | Hamada | F01P 3/02 123/41.74 |

FOREIGN PATENT DOCUMENTS

| | | | | |
|---|---|---|---|---|
| DE | 103 21 035 | | 1/2005 | |
| DE | 10321035 | B3 * | 1/2005 | F02F 1/40 |
| DE | 102005050510 | * | 4/2007 | F02F 1/40 |
| DE | 102005054510 | | 4/2007 | |
| WO | WO 2010040481 | A2 * | 4/2010 | F01P 3/02 |

OTHER PUBLICATIONS

Chinese Search Report issued by the Chinese Patent Office dated Dec. 5, 2016 in counterpart Chinese Patent Application No. 201380072211X.

English translation of Chinese Search Report issued by the Chinese Patent Office dated Dec. 5, 2016 in counterpart Chinese Patent Application No. 201380072211X.

* cited by examiner

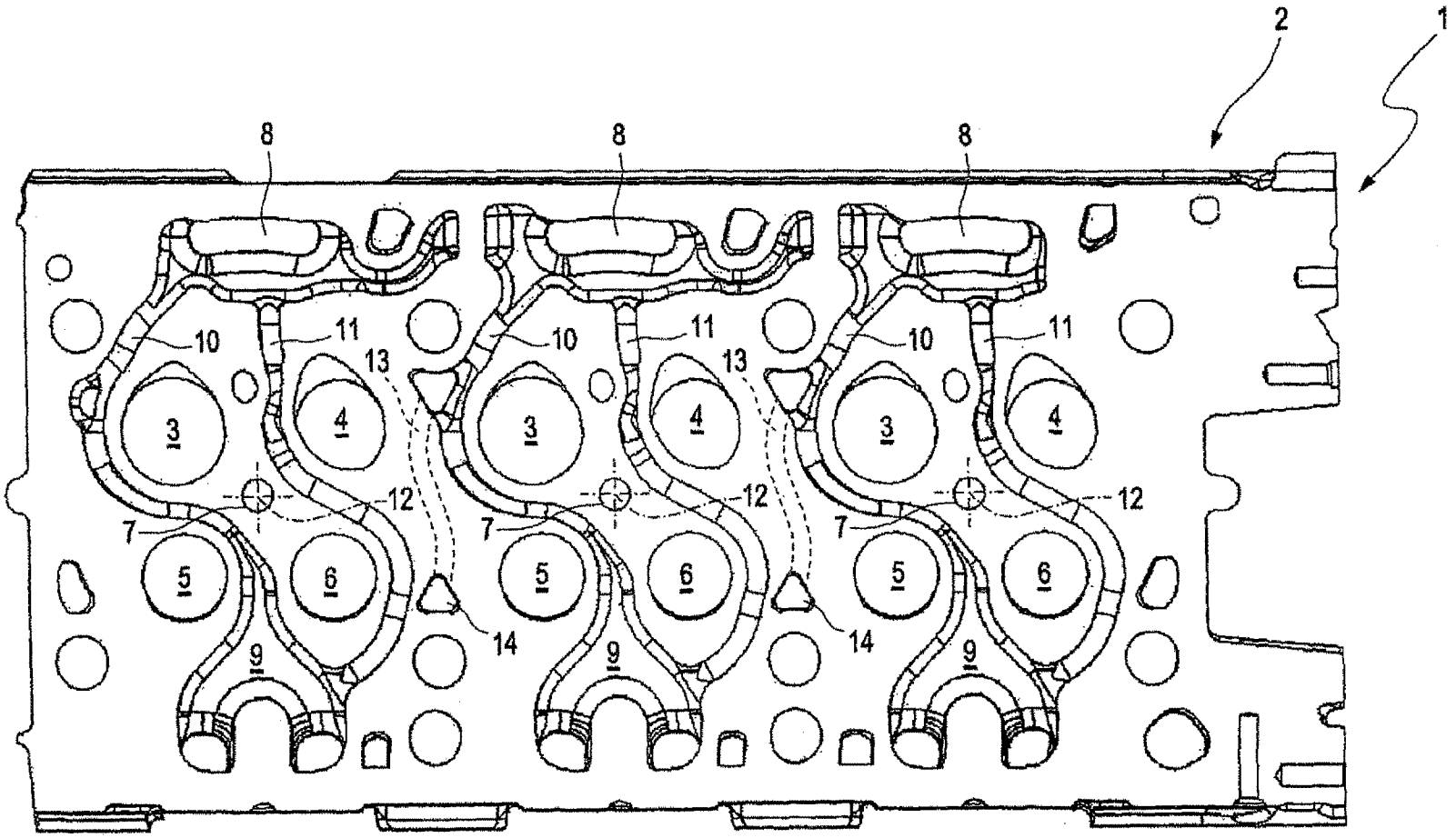
1
2
8
8
8
10
10
10
11
11
11
12
12
12
13
13
14
14
7
7
7
3
4
5
6
9

INTERNAL COMBUSTION ENGINE

CROSS-REFERENCES TO RELATED APPLICATIONS

This application is the U.S. National Stage of International Application No. PCT/EP2013/003669, filed Dec. 5, 2013, which designated the United States and has been published as International Publication No. WO 20141086489and which claims the priority of German Patent Application, Serial No. 10 2012 023 803.7, filed Dec. 5, 2012, pursuant to 35 U.S.C. 119(a)-(d).

BACKGROUND OF THE INVENTION

The invention relates to an internal combustion engine with several cylinders, each of which two intake valves and two exhaust valves, which are each arranged in a valve mount of a cylinder head of the internal combustion engine as well as a coolant distributing chamber and a coolant accumulating chamber are associated to, wherein for each cylinder two coolant ducts are formed in the cylinder head which are each fluidly connected to the corresponding coolant distributing chamber and the corresponding coolant accumulating chamber.

The internal combustion engine may have any number of cylinders. As an alternative, only a single cylinder may be provided. The cylinders have at least some areas which are formed in a cylinder crankcase of the internal combustion engine and are closed or bounded in a direction by the cylinder head. A combustion chamber of the cylinder is hereby positioned on the side proximate to the cylinder head. In order to supply the cylinders with fresh air or a fuel-air mixture, on one hand, and to withdraw exhaust gas therefrom, on the other hand, at least four valves are associated to each cylinder. Two of the valves are hereby configured as intake valves and two further valves as exhaust valves. The valves are arranged in valve mounts of the cylinder head, which open into the cylinder or the combustion chamber.

In order to dissipate heat developing during operation of the internal combustion engine, from the valves, namely the intake valves and the exhaust valves, each cylinder is associated with a cooling device. The latter includes the coolant distributing chamber, the coolant accumulating chamber, and at least two coolant ducts. The coolant ducts are formed in the cylinder head, thus are realized therein hollow spaces. This may also be the case for the two chambers. As an alternative, the chambers may also be formed in the cylinder crankcase, in particular configured therein as hollow spaces. The hollow spaces of the cylinder head and/or the cylinder crankcase, are made, for example, during a casting process. The two coolant ducts of each cylinder are fluidly connected to the coolant distributing chamber of the cylinder and the coolant accumulating chamber of the cylinder, so that a coolant, which is supplied to the coolant distributing chamber, flows through the coolant ducts into the coolant accumulating chamber and is discharged from there.

The publication DE 103 21 035 B3 is known in the art and discloses an internal combustion engine with a cylinder head to delimit a combustion chamber of the internal combustion engine with an inlet side and an outlet side and a coolant circuit for cooling the cylinder head, wherein associated to a combustion chamber are at least two intake valves and two exhaust valves for closing respective inlet and outlet openings which are arranged in the cylinder head, a first accommodation shaft for a spark plug or an injection nozzle, and a coolant chamber of the coolant circuit. Provision is hereby made to guide a coolant flow transversely to the internal combustion engine in longitudinal direction from the outlet side to the inlet side of the cylinder head and to surround a second accommodation shaft for a glow plug between two inlet ducts associated to the intake valves at least in part by the coolant chamber, and for a coolant flow to circulate an area between an inlet duct and the second accommodation shaft.

SUMMARY OF THE INVENTION

Against the background of such an embodiment, it is an object of the invention to propose an internal combustion engine, in which cooling of the intake valves and the exhaust valves is improved.

This is attained in accordance with the invention by an internal combustion engine having a plurality of cylinders, each of which two intake valves and two exhaust valves, respectively arranged in a valve mount of a cylinder head of the internal combustion engine as well as a coolant distributing chamber and a coolant accumulating chamber being associated to, wherein for each cylinder two coolant ducts are formed in the cylinder head and each is fluidly connected to the corresponding coolant distributing chamber and the corresponding coolant accumulating chamber, wherein a first one of the coolant ducts extends on a first side about a first one of the intake valves and on a second side opposite the first side about a first one of the exhaust valves, and a second one of the coolant ducts extends on the first side about a second one of the intake valves and on the second side about a second one of the exhaust valves. Looking at the internal combustion engine in plan view, for example, the first side is to the left of the respective valve and the second side is to the right of the respective valve. Thus, the coolant ducts are, for example, S-shaped or have, in the reverse case, the shape of an S mirrored about its vertical axis. Along its course, the coolant ducts have thus at least similar curvatures or at least the same curvature sign.

In other words, the first of the coolant ducts has at least some areas situated on the first side of the first one of the intake valves and at least some areas situated on the second side of the first one of the exhaust valves, whereas the second of the coolant ducts has at least some areas arranged on the first side of the second one of the intake valves and at least some areas arranged on the second side of the second one of the exhaust valves.

With such a configuration or such a course of the coolant ducts, a reliable cooling in particular can be achieved in the region between the two intake valves. In internal combustion engine known in the art, the presence of, for example, an additional cooling duct is necessary, causing a weakening of the wall thickness in this region. However, in order to attain higher pressures in the cylinder, in particular higher ignition pressures, the rigidity of the cylinder head must be increased. Thus, the need for additional cooling ducts should be eliminated. This is possible by the here described course of the coolant ducts. Moreover, the here described course of the coolant ducts is able to improve cooling of an injector arranged between the valves and/or a plug provided there, in particular spark plug and/or the glow plug.

According to a preferred configuration of the invention, the coolant ducts are arranged in the same plane which is in particular perpendicular to longitudinal center axes of the cylinders, A curvature of the coolant ducts is thus present only within the mentioned plane or perpendicular thereto. The reference to the arrangement of the coolant ducts in the same plane is to be understood as its longitudinal center axis always lying in the same plane, while the coolant ducts, in turn, extend, of course, on both sides for formation of a flow cross section beyond the plane. Particularly preferred is an arrangement of the plane in perpendicular relation to the longitudinal center axes of the cylinder, which coincide, for example, with a movement direction of pistons arranged in the cylinders. This means that the wall thickness of the cylinder head, in particular in the region between the intake valves, can be kept constant, so that, as a result, a greater rigidity is attained in comparison with known internal combustion engines.

According to a preferred embodiment, each coolant distributing chamber is connected via a coolant inlet port and each coolant accumulating chamber is connected via a coolant outlet port to a coolant circuit of the internal combustion engine. Coolant can be supplied via the coolant inlet port to the coolant distributing chamber and then flow through the coolant ducts to the coolant accumulating chamber. The coolant, in turn, can then be discharged via the coolant outlet port. Both the coolant inlet port and the coolant outlet port are connected or at least connectable to the coolant circuit of the internal combustion engine. In particular, the coolant inlet ports of all cylinders and the coolant outlet ports of all cylinders are connected in parallel relation to each other to the coolant circuit; the coolant ducts therefore also extend in terms of flow in parallel relation to each other and are not connected in series.

According to a refinement of the invention, the coolant ducts of each cylinder have the same flow cross section. Thus, there is no difference in the flow cross sections between the cooling ducts associated to the cylinders. Particularly preferred is the configuration of the coolant ducts of all cylinders with the same flow cross section. Furthermore, provision may be made to configure the coolant ducts over their entire longitudinal extension, i.e., in the main flow direction of the coolant, with the same flow cross section.

A further configuration of the invention provides that the first of the intake valves and the first of the exhaust valves as well as the second of the intake valves and the second of the exhaust valves are respectively arranged in symmetry to one another in relation to the symmetry plane which extends through the longitudinal center axis. In particular, the symmetry planes of all cylinders are arranged in parallel relation to each other. Preferably, the symmetry plane also extends perpendicular to a longitudinal axis of the internal combustion engine which longitudinal axis extends through all longitudinal center axes of the cylinders.

Finally, provision may be made to branch a coolant conduit from at least one of the coolant ducts in terms of flow between the coolant distributing chamber and the coolant accumulating chamber. Preferably, the coolant ducts are fluidly connected only via the coolant distributing chamber and the coolant accumulating chamber. They are thus fluidly separated along their course. However, it may be provided to withdraw coolant from or supply coolant into at least one of the coolant ducts, for which purpose the coolant conduit feeds into this coolant duct or branches off therefrom. The coolant conduit is attached on its side distal to the coolant duct to a further region of the internal combustion engine, for example a cooling pocket of the internal combustion engine or the cylinder head.

The invention further relates to a method for the production of an internal combustion engine, in particular an internal combustion engine in accordance with the above description. The internal combustion engine includes several cylinders, each of which two intake valves and two exhaust valves are associated to which are each arranged in a valve mount of a cylinder head of the internal combustion engine. Associated to each cylinder are furthermore a coolant distributing chamber and a coolant accumulating chamber which are either formed in the cylinder head or in a cylinder crankcase, and at least two coolant ducts which are formed in the cylinder head. The coolant ducts are fluidly connected to the corresponding coolant distributing chamber and the corresponding coolant accumulating chamber. When producing the internal combustion engine, a first of the coolant ducts is configured to extend on a first side about a first one of the intake valves and on a second side opposite to the first side to extend about a first one of the exhaust valves. in addition, a second one of the coolant ducts is configured to extend on the first side about a second one of the intake valves and on the second side about a second one of the exhaust valves.

The advantages of such an arrangement have already been discussed above. Both the internal combustion engine and the method for its production can be refined in accordance with the above description, so that reference is made thereto. The production of the coolant ducts is preferably realized with the aid of sand cores. The coolant ducts as well as the coolant distributing chamber and the coolant accumulating chamber are preferably formed in their entirety in the cylinder head. However, as described above, both chambers may also be arranged at least in part, in particular in their entirety in the cylinder crankcase.

BRIEF DESCRIPTION OF THE DRAWING

Exemplary embodiments of the invention will be explained hereinafter in greater detail with reference to the drawing, without limiting the invention. It is shown hereby by the sole FIG. 1 a sectional view of a cylinder head of an internal combustion engine having several cylinders.

DETAILED DESCRIPTION OF PREFERRED EMBODIMENTS

The FIG. 1 shows a sectional view through a region of an internal combustion engine 1, namely through a cylinder head 2 of the internal combustion engine 1. The internal combustion engine 1 has several cylinders, not shown here in greater detail, with two intake valves and two exhaust valves, not shown here in greater detail, being associated to each of the cylinders. The intake valves are arranged or can be arranged in valve mounts 3 and 4, the exhaust valves in valve mounts 5 and 6. Within the scope of this application, the arrangement of an intake valve or exhaust valve always relates to the arrangement of the corresponding valve mounts 3 to 6, or vice versa.

An injector mount 7 can be seen between the valve mounts 3 to 6 of each cylinder. As an alternative, a spark plug may be provided at this location. For cooling the cylinder head 2 or the valves arranged in the valve mounts 3 to 6, a coolant distributing chamber 8, a coolant accumulating chamber 9 and at least two coolant ducts 10 and 11 are associated to each cylinder. The coolant ducts 10 and 11 extend hereby all in the same plane, in particular a plane that is perpendicular to longitudinal central axes 12 of the cylinders. The plane corresponds in the illustration chosen here to the drawing plane. The centers of the coolant ducts 10 and 11 respectively extend hereby in this plane, while the coolant ducts 10 and 11 extend, of course, downwardly and upwardly beyond this drawing plane.

As is readily apparent, the coolant ducts 10 and 11 are each configured in the embodiment shown here, in the shape of an S. As an alternative, a mirrored configuration may, however, also be provided. The configuration is realized such that the coolant ducts 10 and 11 are fluidly separated from each other and extend from the coolant distributing chamber 8 to the coolant accumulating chamber 9. One of the coolant ducts 10 and 11, in this case, the coolant duct 11, extends hereby in a plan view between the valve mounts 3 and 4 for the intake valves and the other one of cooling ducts 10 and 11, here, the coolant duct 10, between the valve mounts 5 and 6 for the exhaust valves. In this way, a particularly good cooling effect for the intake valves and the exhaust valves is realized.

The coolant distributing chamber 8 receives coolant via a coolant inlet port from a coolant circuit of the internal combustion engine 1. It then flows from the coolant distributing chamber 8 into the coolant accumulating chamber 9 and flows from the latter via a coolant outlet port again into the coolant circuit of the internal combustion engine 1. Preferably, the coolant inlet ports of all cylinders are connected in parallel relation to the coolant circuit of the internal combustion engine 1.

To realize a uniform flow through the coolant ducts 10 and 11, the latter have the same flow cross section, in particular over their entire longitudinal extension. It can be provided that a coolant conduit 13 branches from at least one of the coolant ducts 10 and 11, here some of the coolant ducts 10, and is connected on its side distal to the coolant ducts 10 to a coolant pocket 14 which is also formed in the cylinder head 2. With the aid of the coolant conduit 13, regions of the cylinder head 2 at a remote location to the valve mounts 3 to 6 can be reliably supplied with coolant.

What is claimed is:

1. An internal combustion engine, comprising:

a plurality of cylinders, each cylinder operably connected to a respective coolant distributing chamber and a respective coolant accumulating chamber; and a cylinder head including a plurality of valve mounts associated to the cylinders such that each of the cylinders is operably connected to two of the valve mounts for receiving two intake valves, respectively, and operably connected to two of the valve mounts for receiving two exhaust valves, respectively, said cylinder head including for each of the cylinders two coolant ducts fluidly connected to the coolant distributing chamber and the coolant accumulating chamber, said coolant ducts extending fluidly separated from each other from the coolant distributing chamber to the coolant accumulating chamber, wherein the two coolant ducts have a curved configuration such that a first one of the coolant ducts is configured to extend in part on one side of a first one of the intake valves and in part on another side of a first one of the exhaust valves, and a second one of the coolant ducts is configured to extend in part on one side of a second one of the intake valves and another side of a second one of the exhaust valves.

2. The internal combustion engine of claim 1, wherein each of the cooling ducts are in a curved shape so that the first one of the ducts extends outside of the first one of the intake valves and inside of the first one of the exhaust valves, and the second one of the coolant ducts extends inside of the second one of the intake valves and outside of the second one of the exhaust valves.

3. The internal combustion engine of claim 1, wherein each of the cooling ducts are in a curved shape so that the first one of the ducts extends inside of the first one of the intake valves and outside of the first one of the exhaust valves, and the second one of the coolant ducts extends outside of the second one of the intake valves and inside of the second one of the exhaust valves.

4. The internal combustion engine of claim 1, wherein the coolant ducts are arranged in a same plane.

5. The internal combustion engine of claim 4, wherein the plane is perpendicular to a longitudinal center axis of the cylinder.

6. The internal combustion engine of claim 1, further comprising a coolant circuit, said coolant distributing chamber having a coolant inlet port in fluid communication with the coolant circuit, and said coolant accumulating chamber having a coolant outlet port in fluid communication with the coolant circuit.

7. The internal combustion engine of claim 1, wherein the coolant ducts have the same flow cross section.

8. The internal combustion engine of claim 1, wherein the first of the intake valves and the first of the exhaust valves as well as the second of the intake valves and the second of the exhaust valves are respectively arranged in symmetry in relation to a symmetry plane extending through a longitudinal center axis of the cylinder.

9. The internal combustion engine of claim 1, further comprising a coolant conduit branching between the coolant distributing chamber and the coolant accumulating chamber from at least one of the coolant ducts.

* * * * *